United States Patent [19]

Fuhrmeister

[11] 4,410,103

[45] Oct. 18, 1983

[54] SEQUENTIAL UNIT FEEDING APPARATUS

[75] Inventor: Ralph Fuhrmeister, Coopers Plains, Australia

[73] Assignee: Furma Manufacturing Co. Pty. Ltd., Coopers Plains, Australia

[21] Appl. No.: 241,510

[22] Filed: Mar. 9, 1981

[30] Foreign Application Priority Data

Mar. 10, 1980 [AU] Australia ..... PE2692
Jul. 21, 1980 [AU] Australia ..... PE4620

[51] Int. Cl.[3] ..... B21J 15/32

[52] U.S. Cl. ..... 221/25; 221/74; 221/225; 221/278; 227/107; 227/112

[58] Field of Search ..... 221/70–71, 221/74, 69, 224–225, 268, 278, 25, 30; 227/107, 112; 269/13

[56] References Cited

U.S. PATENT DOCUMENTS

| | | | |
|---|---|---|---|
| 3,448,236 | 6/1969 | Spisak | 221/278 |
| 3,516,574 | 6/1970 | André et al. | 221/278 |
| 3,698,599 | 10/1972 | Fernstrom | 221/74 |
| 3,817,422 | 6/1974 | Raitt | 221/74 |
| 3,930,297 | 1/1976 | Potucek et al. | 221/71 |
| 4,222,495 | 9/1980 | Kaneko . | |
| 4,275,583 | 6/1981 | Gilbert et al. . | |
| 4,363,573 | 12/1982 | Ginther et al. | 221/278 |

FOREIGN PATENT DOCUMENTS

| | | | |
|---|---|---|---|
| 1752450 | 5/1971 | Fed. Rep. of Germany . | |
| 2533672 | 2/1976 | Fed. Rep. of Germany . | |
| 2804483 | 8/1978 | Fed. Rep. of Germany | 227/112 |
| 7634831 | 6/1977 | France . | |
| 1255618 | 12/1971 | United Kingdom . | |
| 1316672 | 5/1973 | United Kingdom . | |
| 1406530 | 9/1975 | United Kingdom . | |
| 1333834 | 10/1978 | United Kingdom . | |
| 642072 | 4/1979 | U.S.S.R. . | |
| 742028 | 12/1980 | U.S.S.R. . | |

*Primary Examiner*—Stanley H. Tollberg
*Assistant Examiner*—Russell D. Stormer
*Attorney, Agent, or Firm*—Schwartz, Jeffery, Schwaab, Mack, Blumenthal & Koch

[57] ABSTRACT

Apparatus for sequentially feeding headed fasteners such as rivets includes a carrier band of resiliently stretchable material with the fasteners driven through undersize holes equally spaced along the band, the band being advanced intermittently by a reciprocating actuator, toothed for simultaneous engagement with several of the fastener heads, to bring the fasteners in sequence between a striker and the entry to a delivery conduit, the striker being reciprocated to drive each fastener brought into alignment therewith into the delivery conduit, the fastener head being forced through the stretchable band, a jet of air through the striker impelling the fastener through the delivery conduit.

13 Claims, 6 Drawing Figures

SEQUENTIAL UNIT FEEDING APPARATUS

BACKGROUND OF THE INVENTION

This invention relates to sequential unit feeding apparatus.

Various kinds of devices such as riveting machines, nail guns and screw driving tools require to be fed at controlled intervals with similar headed fasteners, that is to say fasteners such as rivets, nails or screws having shanks with enlarged heads. It is important, for the effective operation of the devices, that the controlled intermittent feeding of the headed fasteners should be completely reliable, and that the feeding apparatus should deliver the individual fasteners accurately and in unfailing sequence, and at the appropriate location to be driven by the riveting machine, nail gun, screw driving tool or the like.

The present invention has for its general object the provision of feeding apparatus for headed fasteners which will satisfy these requirements.

SUMMARY OF THE INVENTION

The invention provides apparatus for the feeding, in sequence, of headed fasteners, particularly rivets, but is applicable to the feeding of nails or screws, for example, the fasteners being first applied to a pliable carrier band made of a resiliently stretchable material, the fasteners having their shanks driven through slightly undersize holes in equally spaced arrangement along the band. The feeding apparatus includes a guide for the band and its fasteners and an actuator which is moved to advance the band intermittently through the guide by simultaneously engaging several of the fasteners and moving them to bring them, one at a time, to rest in alignment with, and between, a striker and the entry to a delivery conduit. The striker is advanced to drive each fastener brought into alignment with it through the band and into the delivery conduit, the head of the driver fastener being thus caused to stretch the band about the hole in which its shank was held. Preferably the actuator is movable reciprocally, having ratchet teeth to engage and move several fastener heads when advanced, and to over-ride fastener heads on its return stroke during which the striker, remaining in the hole from which it has expelled a fastener, prevents the actuator from retracting the band. A fastener, expelled from the band into the delivery conduit, is impelled therethrough by a jet of air under pressure fed through the striker. The entry to the delivery conduit may lead to a selector device which is movable to connect the entry to one of two or more delivery hoses leading from the selector, so the fasteners may be directed to any required one of a number of destinations.

BRIEF DESCRIPTION OF THE DRAWINGS

A preferred embodiment of the invention is shown in the accompanying drawings wherein.

DETAILED DESCRIPTION OF THE PREFERRED EMBODIMENT

Figure 1:
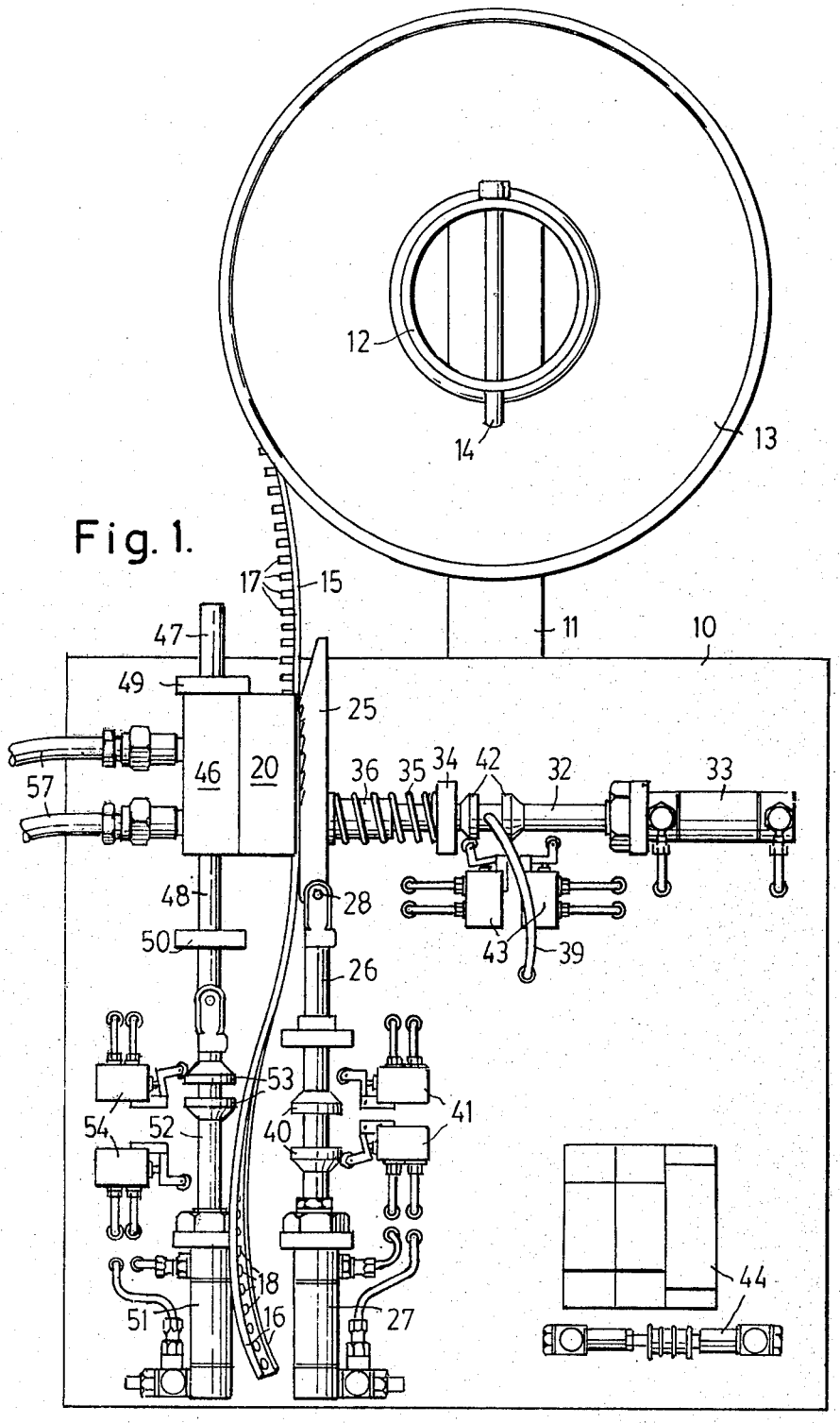
FIG. 1 is a front elevational view of a rivet feeding apparatus according to the invention.

The rivet feeding apparatus illustrated includes a mounting plate 10 with a standard 11 carrying a tubular axle 12 for a reel 13 releasably retained rotatably on the axle by a pin 14.

Wound on the reel is a length of rivet carrier band 15 extruded from a pliable and resiliently stretchable plastics material with beaded or flanged side edges 16 so that the band is of shallow channel form. A multiplicity of rivets 17 are carried by the band in equally spaced arrangement, each rivet having its shank driven through a slightly undersize hole 18 centred on the centre-line of the band, the rivet head 19 being in the channel of the band.

The free end of the carrier band is drawn down from the reel 13 and through a guide block 20 on the mounting plate 10. To facilitate this, the leading end of the band is without rivets. To receive the band, the guide block 20 is formed with a channel 21 in which the band fits closely but slidably. A depression 22 in the upper end of the guide block 20 forms a lead-in for the shanks of the rivets 17 protruding from the band, to guide them into a groove 23 formed in the guide block, leading from the channel 21 and terminating, within the lower part of the guide block, at a round-section hole 24, its axis perpendicular to the channel 21. Below the hole 24 a shallow groove or depression 23*a* continues to the bottom end of the guide block in prolongation of, but considerably shallower than, the groove 23.

An actuator 25 for intermittently advancing the band 15 through the guide block 20 is slidable between the side flanges 16 of the band, and is advanced and retracted by the piston 26 of a first pneumatic cylinder 27, the piston being pivoted at 28 to the lower end of the actuator. The face of the actuator near to the band 15 is formed with a series of ratchet teeth 29 made to engage simultaneously with a like number of the rivet heads 19.

A slotted hole 30 formed through the actuator is entered by a striker 31 projecting coaxially from the piston 32 of a second pneumatic cylinder 33 coaxial with the hole 24 through the guide block 20. The piston 32 is slidable through a bearing block 34 on the mounting plate 10. A helical compression spring 35 is fitted aboun a sleeve 36 through which the piston is slidable and is compressed between the bearing block 34 and a flange 37 on the sleeve to press the sleeve 36 onto the actuator which is therefore pressed firmly towards the guide block 20.

The end of the hole 24 over which the band 15 is drawn is of larger diameter than that of the rivet heads 19; and the hole tapers to a reduced diameter only slightly greater than that of the rivet heads.

An axial passage 38 is formed through the striker 31 and into the piston 32, and air under pressure may be introduced to this passage from a flexible air line 39 leading into the piston.

A pair of coned collars 40 adjustably fixed on the piston 26 of the first pneumatic cylinder 27 are arranged to interact with a pair of pneumatic valves 41 in the pneumatic circuit of the apparatus to control the extent to which the piston, and the connected actuator 25, are advanced and retracted. Similar collars 42 on the piston 32 of the second pneumatic cylinder 33, coacting with pneumatic valves 43, control the stroke of the piston 32 and the striker 31.

Other pneumatic control valve gear, some of which is indicated at 44 is provided on the mounting plate 10 for initiating and controlling the operations of the several pneumatic devices of the apparatus.

When the carrier band 15 is drawn down through the channel 21 of the block 20, the first of the rivets 17 has its head 19 moved into the slotted hole 30 of the actuator. The part of the slotted hole 30 adjacent to the band 15 has its sides cut away, as indicated at 45, and so widened for some distance. The bottom ends of these cut away portions 45 halt the downward movement of the first rivet when it has been drawn down to bring it into coaxial alignment with the striker 31 and the hole 34. A number of the succeeding rivets 17 are then so located that they become engaged by the ratchet teeth 29 of the actuator 25.

A selector block 46 is slidable against the side of the guide block 20 remote from the actuator 25. The selector block is made integrally with coaxial upper and lower shafts 47 and 48 slidable through bearing blocks 49 and 50 respectively. The selector block is movable by a third pneumatic cylinder 51 the piston 52 of which is connected to the lower shaft 48, the strikes being limited by the bearing blocks 49 and 50 and controlled by the interaction of coned collars 53 on the piston 52 and pneumatic valves 54. The movement of the selector block brings one or other of two holes 55 and 56 into coaxial alignment with the hole 24 in the guide block. The two holes 55 and 56 are connected to two flexible delivery hoses 57 in each case by a connector tube 58 and union 59. The internal diameter of each hose and connector tube, and the diameter of each of the holes 55 and 56, is equal to the diameter of the reduced part of the hole 24 in the guide block.

Figure 6:
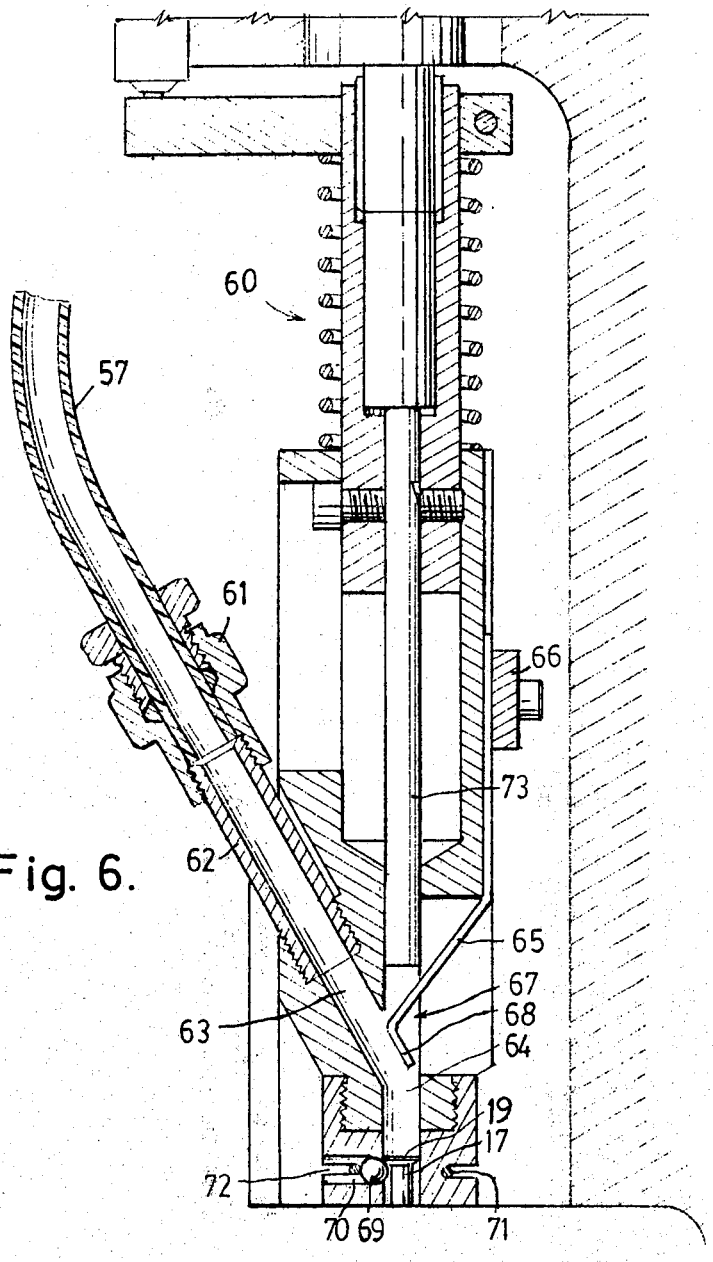
FIG. 6 is a sectional view of part of a riveting machine to which rivets are fed from the feeding apparatus.

The two delivery hoses are connected to two riveting heads of a riveting machine, part of one riveting head 60 of this machine being shown in FIG. 6. A union 61 and connector tube 62 connect each delivery hose to a passage 63 of like diameter leading obliquely into a driver passage 64 of the riveting head 60. A rivet 17 conveyed from the delivery hose 57 and oblique passage 63 into the driver passage 64 is constrained to make a smooth transition from the oblique passage into the driver passage by a guide pawl 65, consisting of a length of resilient wire clamped to the riveting machine at 66, entering the driver passage 64 by way of a slot 67 and having an end piece 68 shaped to form lead-in from the oblique passage 63 to the driver passage 64. The rivet is thus prevented from tilting and being caught in the junction of the passages 63 and 64. The rivet 17 is releasably supported in the driver passage 64 by three steel balls 69 each in a hole 70 which is radial with respect to the driver passage, the balls being urged to protrude into the driver passage 64 by a resilient ring 71 in an annular groove 72 intersecting the three holes 70. The three balls 69 supporting the rivet head 19 align the rivet coaxially in the driver passage 64. The rivet driver 73 of the riveting head 60 may be advanced hydraulically to displace the resilient guide pawl 65 from the driver passage 64 and to strike the rivet 17, driving it from the driver passage 64 to carry out a riveting operation.

In the operation of the rivet feeding apparatus, the striker 31 is advanced to strike a rivet 17 in the band 15 forcing the rivet head 19 through the band which stretches to permit this, the rivet being thus driven into the hole 24 and being impelled through a delivery hose 57 to a riveting head 60 by air discharged under pressure from the striker.

Figure 2:
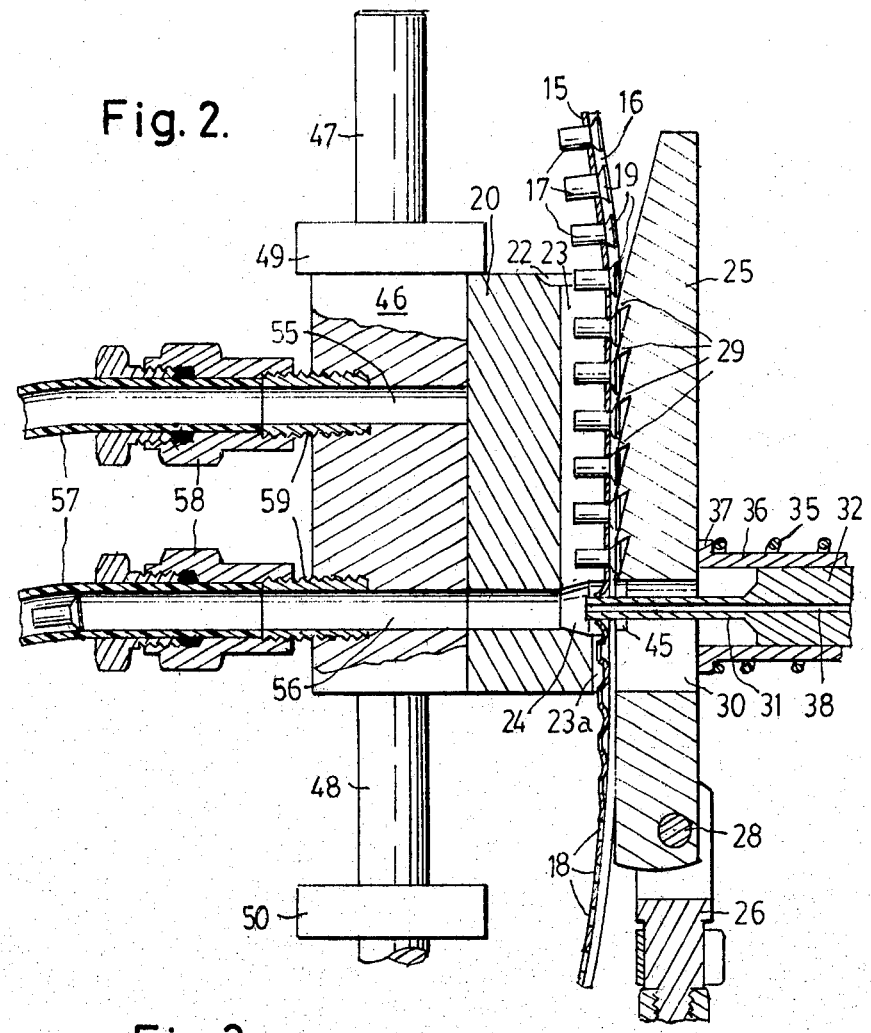
FIG. 2 is a sectional view, to larger scale, of part of the apparatus shown in FIG. 1.
Figure 3:
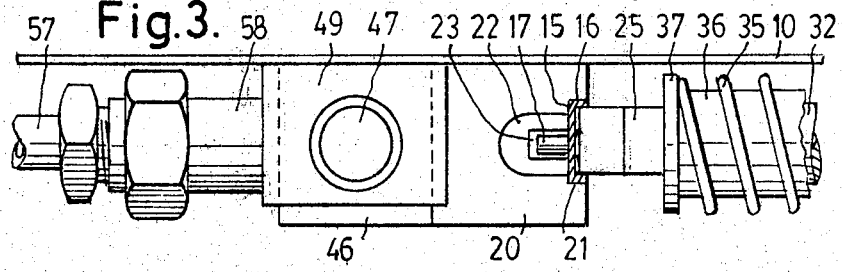
FIG. 3 is a plan view of the parts shown in FIG. 2, FIGS. 4 and 5 are sectional views similar to FIG. 2 but at subsequent stages of rivet feeding.

In the sequence of sequential rivet feeding operations, initially the actuator 25 is retracted and the striker 31 is extended, as shown in FIGS. 1 and 2, the striker, having driven a rivet 17 from the band 15, passing through the hole 18 from which the rivet has been forced.

Figure 4:
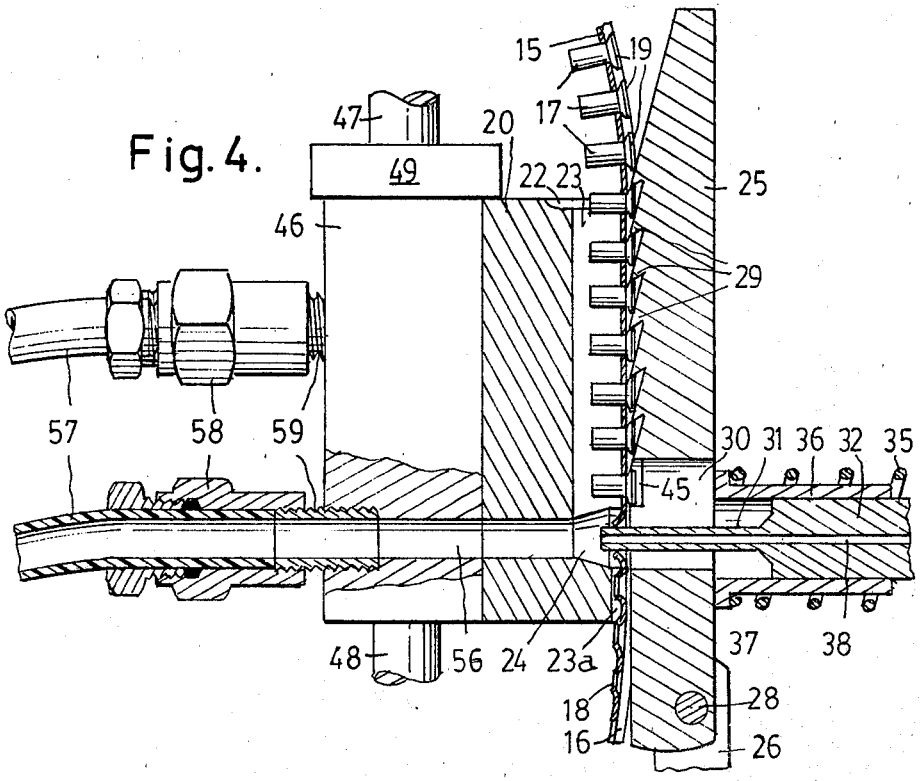

Upon a signal having been received pneumatically from the riveting head 60, the actuator 25 is advanced, its ratchet teeth 29 riding over a number of the rivet heads 19 of the band 15. The band 15 is held by the striker 31 penetrating it, and remains stationary as the actuator is advanced, as shown in FIG. 4.

Figure 5:
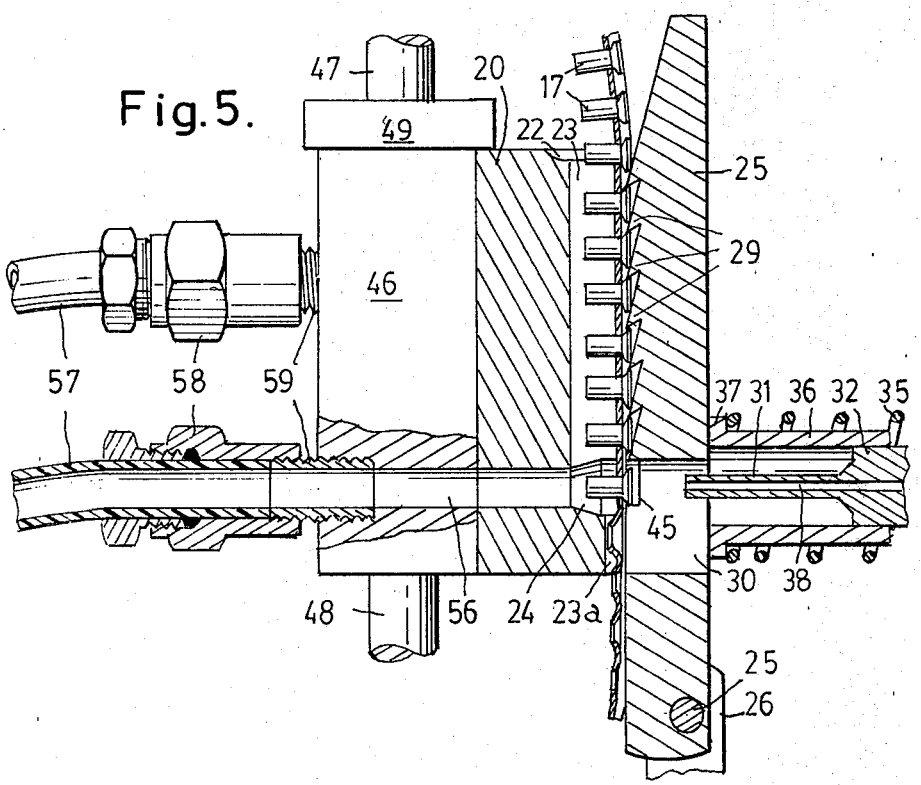

Upon the actuator 25 coming to rest, the striker 31 is automatically retracted, and thereupon the actuator is automatically retracted, its ratchet teeth 29, engaging a like number of rivet heads 19, advancing the band to bring the leading rivet into coaxial alignment with the striker 31, as shown in FIG. 5. It will be seen that this leading rivet is not itself engaged and advanced into the guide block 20 by a ratchet tooth of the actuator, and therefore it will not be likely to be pulled out of correct alignment.

A rivet 17 having previously been fed to the riveting head 60, the hydraulic advance of the riveting head driver 73, when the pressure of the driver reaches a predetermined level, transmits a signal pneumatically to the rivet feeding apparatus causing the striker to advance rapidly to the position shown in FIG. 2, striking the head 19 of the first rivet 17, forcing it through the yieldable carrier band 15, the striker passing through the hole 18 from which the rivet has been ejected into the hole 24. At the same time, air under pressure is fed through the air line 41 into the piston 32 and through the stirrer 31 to cause the rivet 17 to be blown rapidly into a delivery hose 57 and into the riveting machine drive passage 64, in which the rivet driver 73 is then retracted, caught and temporarily supported by the balls 69. The air jet through the striker 31 is then automatically discontinued.

The process of feeding a rivet 17 to one riveting head 60 of the riveting machine is repeated to feed a second rivet to the other riveting head after moving the selector block 46 to bring the second of the two delivery hoses 57 into register with the hole 34 in the guide block 20 by retracting the third pneumatic cylinder piston 52.

In many cases, the rivet feeding apparatus will be required to feed rivets in sequence to a single riveting head, in which case the selector block and its associated parts may be omitted, a single delivery hose 57 being connected directly to the hole 34 in the guide block 20.

When the rivet 17 is driven from the band 15, the material of the band about the hole 18 stretched by the forcing of the considerably oversize rivet head through it, is deformed into the larger-diameter end of the hole 24. The stretched and deformed part of the band does not immediately resume its initial form when the rivet has been ejected, but the shallow groove **23*a* in the block 20 permits free passage of the consequent projection of the band, as may be seen in FIGS. 2, 4 and 5**.

The guide pawl 65, in addition to guiding rivets into the driver passage of a riveting head, also serves to prevent rivets from returning of the oblique passage 63 if the riveting machine should be inverted for riveting in an upward direction.

Apparatus according to the invention will be found to be very effective in achieving the objects for which it has been devised. For the sequential feeding of headed fasteners other than rivets it may be appropriately modified and these, and other, minor modifications of constructional detail and design, which will be readily apparent to skilled persons, are considered to lie within the scope of the invention hereinafter claimed.

I claim:

1. Apparatus for the sequential feeding of headed fasteners including:

a carrier band of pliable resiliently deformable material, with the shanks of a multiplicity of similar fasteners driven in the same direction through apertures equally spaced along the band, a delivery conduit, a striker aligned with the entry to the delivery conduit, guide means adapted to guide the carrier band between the striker and the entry to the delivery conduit, an actuator adapted to engage fasteners in the carrier band and to advance them to bring each in sequence into alignment with the striker, said actuator comprising a toothed member with ratchet teeth adapted to engage simultaneously a plurality of heads of fasteners in the band, means for urging the toothed member to the carrier head, and means for reciprocating the toothed member, its teeth being adapted to over-ride fastener heads on one stroke and to advance them on the return stroke, and means for moving the striker to drive each of the fasteners brought into alignment therewith in such manner as to force the head of the fastener through the band and expel the fastener into the delivery conduit.

2. Apparatus according to claim 1 further including air passage means in flow communication with said delivery conduit, and means for directing air under pressure through said air passage means to impel fasteners expelled into the delivery conduit.

3. Apparatus according to claim 2, wherein said air passage means is formed through the striker.

4. Apparatus according to claim 1 wherein said carrier band is formed with side flanges, and said toothed member is reciprocally slidable between the side flanges.

5. Apparatus according to claim 1 wherein said striker is a reciprocally movable rod which, when advanced, moves through a slotted aperture formed in said toothed member of the actuator.

6. Apparatus according to claim 1, further including a guide pawl positioned adjacent said delivery conduit, said guide pawl guiding fasteners impelled through the conduit and preventing the return of such fasteners.

7. Apparatus according to claim 1 wherein said delivery conduit includes a fixed entry, a movable selector member, a plurality of passages in the selector member, each connected to a delivery hose, and means for moving the selector member to bring any one of the passages therein into register with the fixed entry.

8. Apparatus for the sequential feeding of headed fasteners including:

a carrier band of pliable resiliently deformable material, with the shanks of a multiplicity of similar fasteners driven in the same direction through apertures equally spaced along the band, guide means adapted to guide the carrier band, said guide means being formed with a delivery opening through which each fastener is expelled, a striker aligned with said delivery opening in said guide means, an actuator adapted to engage fasteners in the carrier band and to advance them to bring each in sequence into alignment with the striker, said actuator comprising a toothed member with ratchet teeth adapted to engage simultaneously a plurality of heads of fasteners in the band, means for urging the toothed member to the carrier band, and means for reciprocating the toothed member, its teeth being adapted to over-ride fastener heads on one stroke and to advance them on the return stroke, and means for moving the striker to drive each of the fasteners brought into alignment therewith in such manner as to force the head of the fastener through the band and expel the fastener into the delivery opening.

9. Apparatus according to claim 8 further including a delivery conduit communicating with said delivery opening, air passage means in flow communication with said delivery conduit, and means for directing air under pressure through said air pressure means to impel fasteners expelled into the delivery conduit.

10. Apparatus according to claim 9 wherein said air passage means is formed through the striker.

11. Apparatus according to claim 9, further including a guide pawl positioned adjacent said delivery conduit, said guide pawl guiding fasteners impelled through the conduit and preventing the return of such fasteners.

12. Apparatus according to claim 8 wherein said carrier band is formed with side flanges, and the toothed member is reciprocally slidable between the side flanges.

13. Apparatus according to claim 8 wherein said striker is a reciprocally movable rod which, when advanced, moves through a slotted aperture formed in said toothed member of the actuator, and into said delivery opening.

* * * * *